US007639969B2

(12) United States Patent
Horinoe et al.

(10) Patent No.: US 7,639,969 B2
(45) Date of Patent: Dec. 29, 2009

(54) DEVELOPING DEVICE REDUCING TONER PRESSURE ON SUPPLY ROLLER AND IMAGE FORMING APPARATUS USING SAME

(75) Inventors: Mitsuru Horinoe, Chita-gun (JP); Shougo Sato, Seto (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/809,531

(22) Filed: Mar. 26, 2004

(65) Prior Publication Data

US 2004/0190938 A1 Sep. 30, 2004

(30) Foreign Application Priority Data

Mar. 28, 2003 (JP) ..... 2003-092409

(51) Int. Cl.
*G03G 15/08* (2006.01)

(52) U.S. Cl. ..... 399/119; 399/262

(58) Field of Classification Search ..... 399/119, 399/222, 255, 252, 262, 263, 284, 274
See application file for complete search history.

(56) References Cited

U.S. PATENT DOCUMENTS 5,116,712 A * 5/1992 Nakamura et al. ..... 430/108.2
5,137,796 A * 8/1992 Takiguchi et al. ..... 430/110.4
5,215,845 A 6/1993 Yusa et al.
5,262,267 A * 11/1993 Takiguchi et al. ..... 430/122
5,384,628 A * 1/1995 Takami et al. ..... 399/255
5,718,999 A * 2/1998 Suzuki et al. ..... 430/109.3
5,857,134 A 1/1999 Ahn
6,041,203 A 3/2000 Suzuki et al.
6,101,350 A 8/2000 Suzuki et al.
6,256,471 B1 7/2001 Sato et al.
6,337,956 B1 1/2002 Sato et al.
6,339,689 B1 1/2002 Sugiura
6,449,442 B1 9/2002 Shida et al.
6,546,213 B2 * 4/2003 Ito et al. ..... 399/27
6,594,462 B2 * 7/2003 Ishii et al. ..... 399/281
6,708,011 B2 3/2004 Nomura et al.
6,801,740 B2 * 10/2004 Ito et al. ..... 399/284
2002/0041778 A1 * 4/2002 Muto et al. ..... 399/281
2002/0159781 A1 * 10/2002 Hatori ..... 399/30
2003/0118374 A1 * 6/2003 Eun et al. ..... 399/252

(Continued)

FOREIGN PATENT DOCUMENTS

EP 1 031 893 A1 8/2000

(Continued)

*Primary Examiner*—Quana M Grainger
(74) *Attorney, Agent, or Firm*—Oliff & Berridge, PLC

(57) ABSTRACT

A tandem-type color laser printer is provided with process units for each color which are arranged horizontally and in parallel with each other. In a developing unit in each process unit, a supply roller and a developing roller are disposed below a toner chamber, and a supply roller upper-side wall portion that covers the supply roller from above is provided between the toner chamber and the supply roller. This structure prevents the weight of toner stored in the toner chamber from directly acting on the supply roller, enables the toner between the supply roller upper-side wall portion and the supply roller to flow with the rotation of the supply roller, and secures preferable circulation of the toner.

29 Claims, 4 Drawing Sheets

U.S. PATENT DOCUMENTS

2004/0053153 A1 * 3/2004 Yaguchi et al. ..... 430/106.1

FOREIGN PATENT DOCUMENTS

| | | | | |
|---|---|---|---|---|
| EP | 1 041 452 | A2 | | 10/2000 |
| JP | A-4-162049 | | | 6/1992 |
| JP | 06289705 | A | * | 10/1994 |
| JP | 07253709 | A | * | 10/1995 |
| JP | 08006386 | A | * | 1/1996 |
| JP | 08030099 | A | * | 2/1996 |
| JP | A 9-101676 | | | 4/1997 |
| JP | 09146354 | A | * | 6/1997 |
| JP | A 9-160377 | | | 6/1997 |
| JP | A 9-274423 | | | 10/1997 |
| JP | A 11-282235 | | | 10/1999 |
| JP | A 2000-258986 | | | 9/2000 |
| JP | A-2000-275963 | | | 10/2000 |
| JP | A 2001-66861 | | | 3/2001 |
| JP | A-2001-272854 | | | 10/2001 |

* cited by examiner

DEVELOPING DEVICE REDUCING TONER PRESSURE ON SUPPLY ROLLER AND IMAGE FORMING APPARATUS USING SAME

This application claims priority from JP 2003-092409, filed Mar. 28, 2003, the contents of which are incorporated by reference thereto in their entirety herein.

BACKGROUND OF THE INVENTION

1. Field of Invention

The invention relates to an image forming apparatus, such as a color laser printer, and a developing device mounted in the image forming apparatus.

2. Description of Related Art

As an electrophotographic color laser printer, a tandem color laser is known. The tandem color laser printer includes the same number of process units therein as there is toner colors of yellow, magenta, cyan, and black. Each process unit has a developing agent hopper, a supply roller, a developing roller, and a photosensitive drum.

In the tandem color laser printer, toner of each color stored in the developing agent hopper is supplied by the supply roller to the developing roller in each process unit. An electrostatic latent image carried on the photosensitive drum is developed by the developing roller, and toner images of each color are simultaneously formed. Thus, a color image can be formed at substantially the same speed as that of a monochrome laser printer.

An example of this kind of tandem color laser printer is disclosed in Japanese Patent Application No. 9-274423 where each process unit is arranged horizontally in parallel to each other.

However, in the tandem color laser printer disclosed, the developing agent hopper is disposed above the supply roller, the weight of toner stored in the developing agent hopper directly acts on the supply roller from above. As a result, even when the supply roller is rotated, toner scraped from the developing roller by the supply roller is not circulated, and remains near the supply roller. As the scraped toner deteriorates, if supplied from the supply roller to the developing roller, fogging may occur.

SUMMARY OF THE INVENTION

The invention provides a developing device that forms a preferable image and an image forming apparatus to which the developing device is mounted.

According to one form of the invention, a developing device that is detachably attached to a main casing of an image forming apparatus, may include a developing agent container that contains a developing agent; a developing agent carrier that carries the developing agent; a supply device that is disposed facing the developing agent carrier and supplies the developing agent stored in the developing agent container to the developing agent carrier, and a first wall that is disposed between the developing agent container and the supply device and covers an upper portion of the supply device when the developing device is mounted in the main casing of the image forming apparatus. The developing agent carrier and the supply device are disposed below the developing agent container when the developing device is mounted in the main casing of the image forming apparatus.

According to another form of the invention, a developing device, that is detachably attached to a main casing of an image forming apparatus, may include a developing agent container that contains a developing agent; a developing agent carrier that carries the developing agent; a supply device that is disposed facing the developing agent carrier and supplies the developing agent stored in the developing agent container to the developing agent carrier, and a first means that prevents a weight of the developing agent contained in the developing agent container from directly acting on the supply device. The developing agent carrier and the supply device are disposed below the developing agent container when the developing device is mounted in the main casing of the image forming apparatus.

According to yet another form of the invention, a developing device, that is detachably attached to a main casing of an image forming apparatus, may include a developing agent container that contains a developing agent; a developing agent carrier that carries the developing agent; a supply device that is disposed facing the developing agent carrier and supplies the developing agent stored in the developing agent container to the developing agent carrier. The developing agent carrier and the supply device are disposed below the developing agent container when the developing device is mounted in the main casing of the image forming apparatus. The developing agent has a packed bulk density of greater than or equal to 0.646 g/ml at an initial use.

According to a further form of the invention, an image forming apparatus may include a main frame and a developing unit that is detachably attached to the main frame. The developing unit may include a developing agent container that contains a developing agent; a developing agent carrier that carries the developing agent; a supply device that is disposed facing the developing agent carrier and supplies the developing agent stored in the developing agent container to the developing agent carrier, and a first wall disposed between the developing agent container and the supply device and covers an upper portion of the supply device when the developing device is mounted in the main casing of the image forming apparatus. The developing agent carrier and the supply device are disposed below the developing agent container when the developing device is mounted in the main casing of the image forming apparatus.

A developing unit for use with an electrorephotographic print device, the developing unit comprising a casing having a front wall, a rear wall, a top wall, and a pair of side walls. The casing is divided into a toner chamber and a developing chamber. A first wall extends from the front wall into the casing to create the toner chamber and the developing chamber with an agitator mounted in the toner chamber. A supply roller is mounted in the developing chamber adjacent to the first wall and the front wall and a developing roller is mounted in the developing chamber to contact the supply roller on a side away from the first wall. A regulating blade extends from the back wall and is in contact with the developing roller. Further, a second wall extends from the back wall with a free end contacting the regulating blade at a side opposite where the regulating blade contacts the developing roller. The second wall is joined to the rear wall closer to the toner chamber than where the free end of the second wall contacts the regulating blade.

BRIEF DESCRIPTION OF THE DRAWINGS

An embodiment of the invention will be described in detail with reference to the following figures wherein.

DETAILED DESCRIPTION OF PREFERRED EMBODIMENTS

Figure 1:
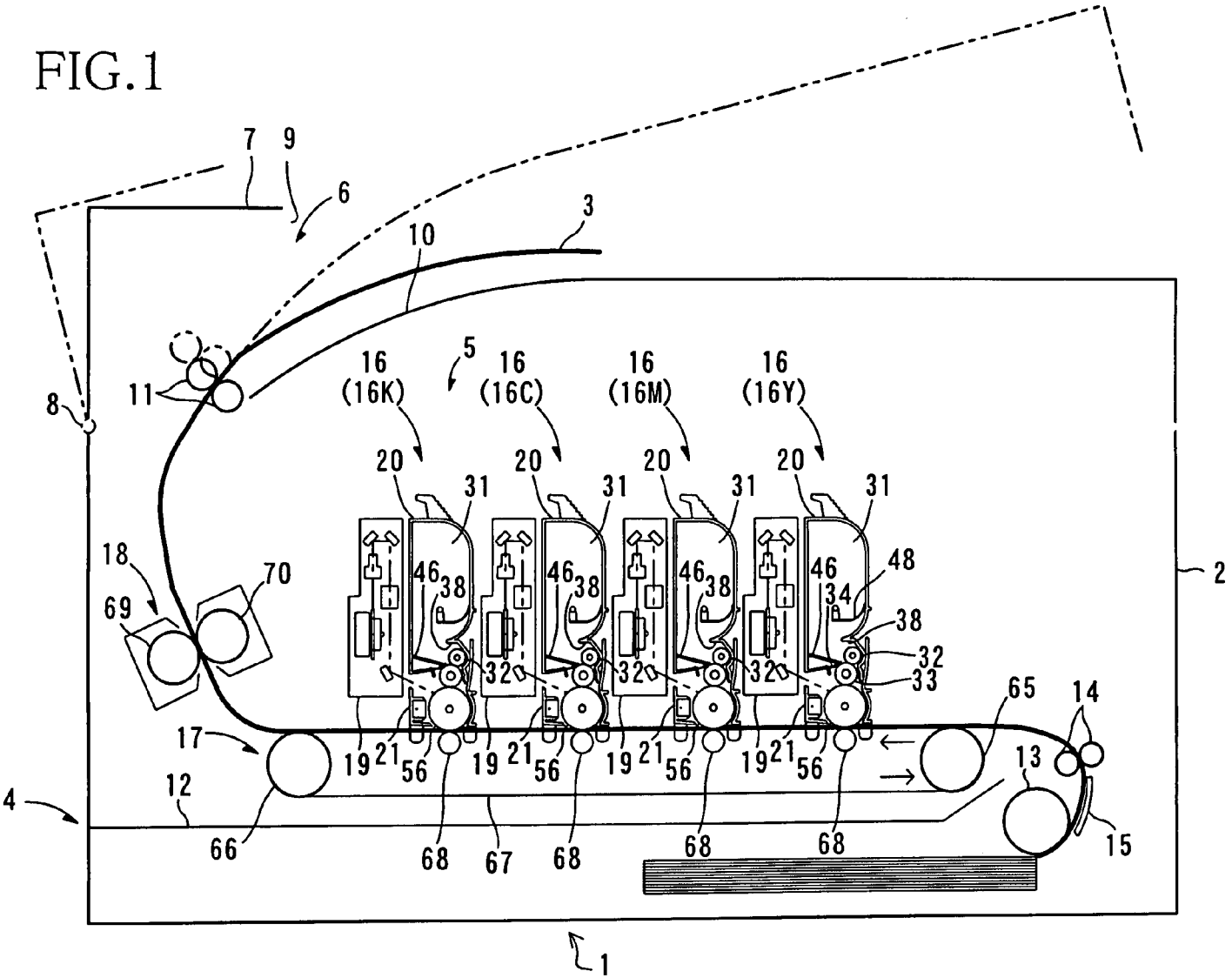
FIG. 1 is a side sectional view of essential parts of a color laser printer as an image forming apparatus according to an embodiment of the invention.

In FIG. 1, the color laser printer 1 is a tandem color laser printer in which a plurality of process units 16 are arranged in tandem with each other in a horizontal direction. The color laser printer 1 includes, in a main casing 2, a sheet feeding unit 4 that supplies a sheet 3, an image forming part 5 that performs image formation on the sheet 3 fed therein, and a sheet ejection part 6 that ejects the sheet 3 on which the image is formed.

The main casing 2 has a rectangular box shape in a side sectional view. The main casing 2 is structured so as to open at its upper side, and covered with a top cover 7 at the upper side. The top cover 7 is supported at a rear side of the main casing 2 (in the following description, the left side in FIG. 1 is regarded as the rear side and the right side as a front side) rotatably about a hinge 8 and provided openably (phantom line) and closably (solid line) to the main casing 2.

The top cover 7 includes a sheet discharge slot 9 that discharges the sheet 3, a sheet discharge tray 10 that recesses deeper toward the sheet discharge slot 9, and ejection rollers 11 provided at rear end portion of the sheet discharge tray 10 in the sheet discharge slot 9. The sheet discharge slot 9, the sheet discharge tray 10, and the ejection rollers 11 are moved integrally with the top cover 7 when the top cover 7 is opened and closed.

The sheet feeding unit 4 is provided at a bottom portion in the main casing 2, and includes a sheet supply tray 12, a sheet supply roller 13, conveying rollers 14, and a guide member 15. The sheet supply tray 12 is detachably attached to the main casing 2 from the front side in a horizontal direction. The sheet supply roller 13 and the guide roller 15 are attached to an upper portion of the sheet supply tray 12 at one end (at the front side). The conveying rollers 14 are provided at a downstream side from the sheet supply roller 13 in a sheet feed direction and attached to the main casing 2.

In the sheet supply tray 12, sheets 3 are stacked, from which an uppermost sheet 3 is supplied, one by one, toward the conveying rollers 14 upon the rotation of the sheet supply roller 13. The sheet 3 is conveyed from the conveying rollers 14 to a transfer position between a conveyor belt 67 and each photosensitive drum 56.

The guide member 15 is provided between the sheet supply roller 13 and the conveying rollers 14 in a vertical direction. The sheet 3 supplied by the sheet supply roller 13 is guided to the conveying rollers 14 by the guide member 15, and conveyed from the conveying rollers 14 toward the transfer position between the conveyor belt 67 and each photosensitive drum 56 successively positioned rearwardly.

The image forming part 5 includes the process units 16, a transfer part 17, and a fixing part 18. A process unit 16 is provided for each toner color of a plurality of toner colors. That is, the process units 16 are a yellow process unit 16Y, a magenta process unit 16M, a cyan process unit 16C, and a black process unit 16K. The process units 16 are sequentially disposed at a specified distance away so as to overlap, or be aligned with, each other in the horizontal direction.

Each process unit 16 is identical in shape, structure and operation, and includes a scanner unit 19, a developing unit 20 as a developing device, and a photosensitive drum unit 21.

The scanner unit 19 is disposed at a specified distance away from the conveyor belt 67 in a vertical direction, and each scanner unit 19 is fixed to the main casing 2.

Figure 2:
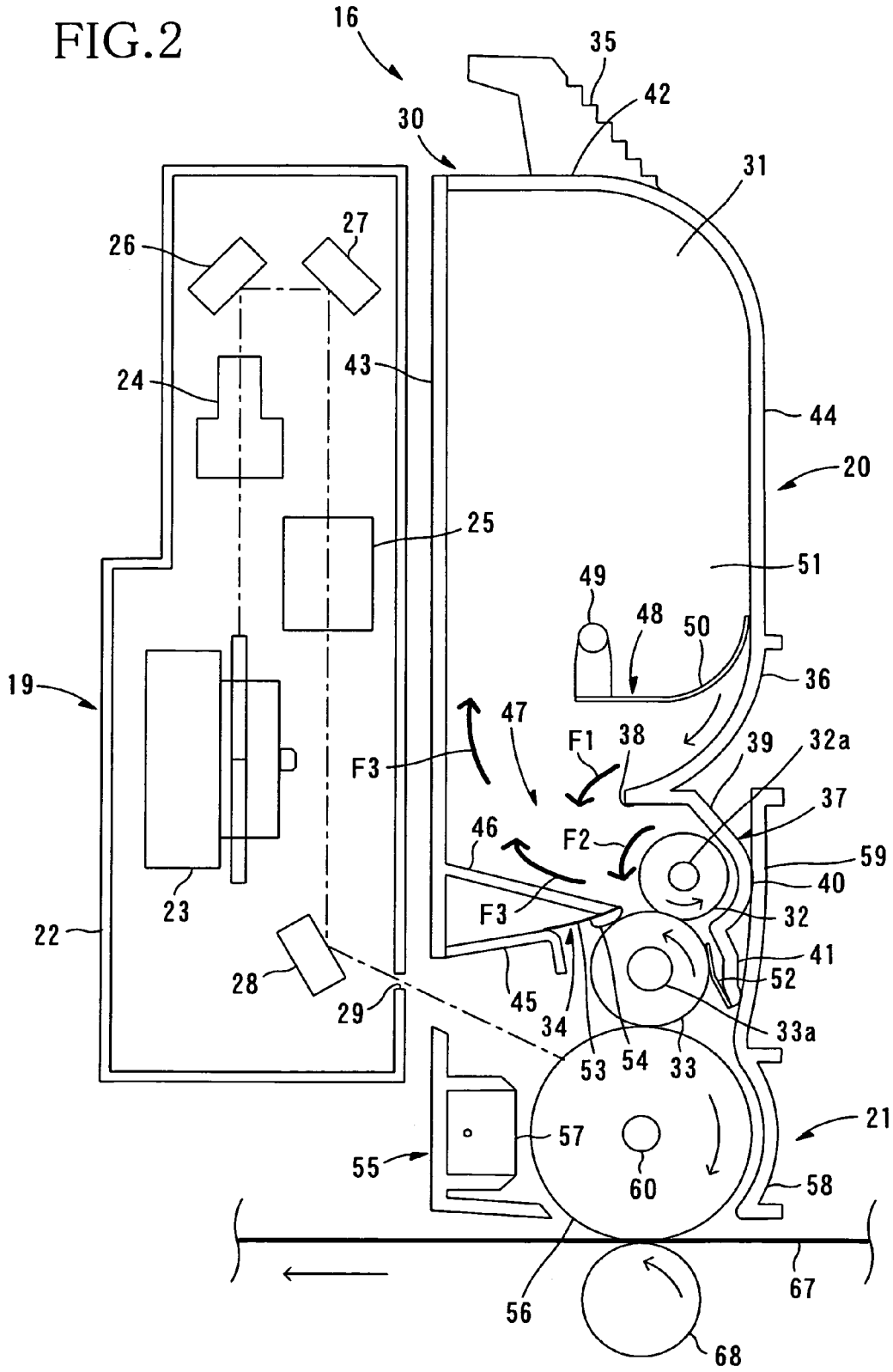
FIG. 2 is an enlarged side sectional view of essential parts of a process unit in FIG. 1.

As shown in FIG. 2, the scanner unit 19 includes a laser emitting portion (not shown), a polygon mirror 23, two lenses 24, 25, and three reflecting mirrors 26, 27, 28, in a scanner casing 22. The scanner casing 22 has a substantially rectangular box shape in a side sectional view, and is fixed to the main casing 2 with its longitudinal direction orientated in the vertical direction. A window 29, through which a laser beam is emitted, is formed on a wall of the scanner casing 2 facing the photosensitive drum unit 21.

In the scanner unit 19, a laser beam emitted from the laser emitting portion, based on print data, sequentially passes through or reflects from the polygon mirror 23, the lens 24, the reflecting mirror 26, the reflecting mirror 27, the lens 25, and the reflecting mirror 28 in order, and is emitted from the window 29. The laser beam emitted from the window 29 is directed to the photosensitive drum 56 by high speed scanning.

Each scanner unit 19 is disposed substantially at an identical position in the vertical direction. That is, the scanner units 19 are disposed so as to be horizontally aligned (FIG. 1).

Each developing unit 20 is detachably attached to the main casing 2, and includes a toner chamber 31 as a developing agent container, a supply roller 32 as a supply device, a developing roller 33 as a developing agent carrier, and a layer thickness regulating blade 34 as a layer thickness regulating member, in a development casing 30.

The development casing 30 has a substantially rectangular box shape in a side sectional view, which is openable at its lower side. A holding part 35 for holding the development casing 30 is provided on a top wall 42. The holding part 35 is formed to protrude upward from the top wall 42 of the development casing 30 in the form of substantially a triangle when viewed in a side sectional view. A front face of the holding part 35 is formed in saw-toothed shape so to enable a secure grip by hand.

A rear wall 43 of the development casing 30 is formed substantially in a plane that is parallel to a front wall of the scanner casing 22, also formed in a plane.

A front wall 44 of the development casing 30 is formed, in a side sectional view, such that a corner portion at its upper end is curved continuously to join with the top wall 42. A middle of the front wall 44 with respect to a top and bottom direction thereof is formed substantially parallel to the rear wall 43. A lower end portion of the front wall 44 is an agitator facing wall 36, as part of a first wall, that is a portion facing an agitator 48 provided in the toner chamber 31, and is formed in a curve (downward and rearward) as seen in a side sectional view along a rotation path of the agitator 48. A cover wall 37 that covers the supply roller 32 and the developing roller 33 is formed at a lower location than the agitator facing wall 36 and is in the front wall 44 of the development casing 30.

The cover wall 37 is folded continuously from the rear end portion of the agitator facing wall 36 which extends in a curve rearward in the side sectional view. The cover wall 37 is made up of a supply roller upper wall portion 38, a supply roller inclined wall portion 39, a supply roller front-side cover wall portion 40, and a developing roller front-side cover wall portion 41, which are formed integrally. The supply roller upper wall portion 38, which also functions as part of the first wall, extends frontward in a horizontal direction. The supply roller inclined wall portion 39, which functions as part of the first wall, continues from the front end portion of the supply roller upper wall portion 38, and extends frontward and downward. The supply roller front-side cover wall portion 40 continues from the front end portion of the supply roller inclined wall portion 39 and extends in a curve, in the side sectional view, along an outer surface of the supply roller 32 (in a curve where the top and bottom ends are disposed rearward and the middle is disposed frontward in the side sectional view). The developing roller front-side cover wall portion 41 is folded continuously from the rear end portion of the supply roller front-side cover wall portion 40, that extends in a curve rearward, and extends frontward and rearward.

The supply roller upper wall portion 38 and the supply roller inclined wall portion 39 are provided between the toner chamber 31 and the supply roller 32 so as to cover the supply roller 32 from above. More specifically, the supply roller upper wall portion 38 and the supply roller inclined wall portion 39 are provided near the supply roller 32 such that a roller portion of the supply roller 32 can be entirely placed within a plane of projection, in a vertical direction of the supply roller upper wall portion 38 and the supply roller inclined wall portion 39, and in particular, such that the rear end portion of the supply roller upper wall portion 38 can be disposed rearward further than a rear side of the supply roller 32 yet still near the supply roller 32.

According to this structure, as the first wall, that covers the upper portion of the supply roller, is disposed between the toner chamber and the supply roller, that is arranged thereunder, the weight of the developing agent stored in the toner chamber can be received at the first wall, thereby preventing the weight of the developing agent from directly acting on the supply roller. Throughout this description developing agent and toner are used interchangeably as the material used to develop the image. As a result, the developing agent scraped from the developing roller can flow along with a movement of the supply roller without interference, and fogging caused by a circulation failure of the scraped developing agent can be reduced, thereby obtaining excellent image formation. Further, the weight of the developing agent can be more reliably and stably prevented from directly acting on the supply roller.

A blade support wall 45 is bent and extends upwardly from the lower end portion of the rear wall 43 of the development casing 30 toward the front, and is joined to the rear wall 43. A free end of the blade support wall 45 is disposed so as to face the rear side surface of the developing roller 33.

A guide wall 46, as a second wall, is provided near the lower end portion of the rear wall 43 of the development casing 30 in such a manner that it extends slightly obliquely downward toward the front and covers the blade support wall 45 from above. More specifically, the guide wall 46 extends from the rear wall surface 43, at its rear end portion, such that the front end portion is located above the developing roller 33 and disposed near a position where the developing roller 33 and the layer thickness regulating blade 34 face each other. Thereby, the guide wall 46 is disposed such that its front end portion, close to the developing roller 33, inclines downward and its rear end portion far from the developing roller 33 inclines upward, respectively relative to a horizontal direction, while covering the blade support wall 45 and the layer thickness regulating blade 34 from above.

The guide wall 46 is a flat surface and is provided across the entire width of the development casing 30 (in a direction perpendicular to a front to rear direction in a plan view).

The development casing 30 is made of a polyethylene resin, for example. The rear wall 43 and the guide wall 46 are formed integrally. The top wall 42, the front wall 44 (including the agitator facing wall 36 and the cover wall 37 ), the blade support wall 45 and both side walls 51 are formed integrally. Both side walls 51 extend oppositely from both sides of the front wall 44, with respect to its width, to the rear wall 43. A rear end portion of the top wall 42 and rear end portions of both side walls 51 are welded to the upper end portion and both side portions of the rear wall 43, respectively. A rear end portion of the blade support wall 45 is welded to a lower end portion of the rear wall 43. The development casing 30 is thus formed.

In the development casing 30, an upper internal space from the top wall 42 to the lower end portion of the agitator facing wall 36 (that is, the rear end portion of the agitator facing wall 36 that continues to the supply roller upper wall portion 38 by the fold) is structured as the toner chamber 31. An internal space thereunder, that is a lower internal space from the supply roller upper wall portion 38 to the lower end portion of the developing roller front-side cover wall portion 41 in a vertical direction, is structured as the developing chamber 47 that includes the supply roller 32, the developing roller 33, and the layer thickness regulating blade 34 therein.

The toner chamber 31 contains nonmagnetic single-component polymerized toner of a color, that is to be positively charged, as a developing agent. In the toner chamber 31, each process unit 16 includes a color toner. The yellow process unit 16Y includes yellow toner, the magenta process unit 16M includes magenta toner, the cyan process unit 16C includes cyan toner, and the black process unit 16K includes black toner.

More specifically, toner of each color is a polymerized toner having substantially spherical particles obtained through copolymerization. The polymerized toner has binder resin as the main ingredient, which is obtained through copolymerization of styrene-based monomers, such as styrene, and acryl-based monomers, such as acrylic acid, alkyl (C1–C4) acrylate, and alkyl (C1–C4) methacrylate, using a known polymerization method, such as suspension polymerization. A coloring agent, a charge control agent, and wax are added to the polymerized toner to form toner base particles. An external additive is also added to the polymerized toner to improve flowability.

As a coloring agent, each coloring agent of yellow, magenta, cyan, and black is formulated. As a charge control agent, combined is a charge control agent obtained through copolymerization of ion-based monomers having an ionized functional group, such as ammonium salt, and monomers that can be copolymerized with ion-based monomers, such as styrene-based monomers and acryl-based monomers. As an external additive, combined is inorganic powder, such as metallic oxide powder, carbonized powder, and metal salt powder. The metallic oxide powder includes silica, aluminum oxide, titanium oxide, strontium titanate, ceric oxide, and magnesium oxide.

Because such polymerized toner is obtained through copolymerization, its particle shape is spherical and its particle size is uniform, and thus the polymerized toner has excellent flowability and can be circulated stably.

In the embodiment, a toner whose packed bulk density in an early use (including unused state) is greater than or equal to 0.646 g/ml is used. Such a toner can be sufficiently supplied, even in early or initial use, from the toner chamber 31 to the supply roller 32. Thus, a drop in image formation density in the early use can be prevented and excellent images can be formed.

The packed bulk density can be found by filling more than 100 ml of toner in a cylindrical tube, tapping the cylindrical tube 180 times, separating the upper part of the cylindrical tube to scrape 100 ml of toner, and measuring its weight using Powder Tester PT-R manufactured by Hosokawa Micron.

The agitator 48, as an agitating device that agitates toner, is provided in a lower part of the toner chamber 31. The agitator 48 includes a rotary shaft 49 rotatably supported at both side walls 51, and an agitating member 50 made of a film extending from the rotary shaft 49 in a radial direction.

In the agitator 48, power from a motor (not shown) is inputted to the rotary shaft 49, the rotary shaft 49 is rotated, and thus, the agitating member 50 is rotated in the direction of the arrow (clockwise). When the agitating member 50 makes contact with the agitator facing wall 36 of the front wall 44 of the development casing 30, a free end of the agitating member 50 is bent toward an upstream side in the rotation direction of the agitating member 50 and slides over the agitator facing wall 36. Through the agitation of the agitating member 50, toner in the toner chamber 31 flows from the rear end portion of the agitator facing wall 36 to the developing chamber 47 (refer to a first flow F1).

The supply roller 32 is provided along the supply roller front-side cover wall portion 40 formed in a curve under the supply roller upper wall portion 38 at the front upper side of the developing chamber 47.

More specifically, the supply roller 32 is located such that a distance between the supply roller 32 and the supply roller upper wall portion 38 is 0–10 mm. A distance between the supply roller 32 and the supply roller front-side cover wall portion 40 is set to 0–2 mm.

The supply roller 32 is made by covering a metallic roller shaft 32 a with a roller portion made of a conductive sponge. The outside diameter of the supply roller 32 is formed smaller than that of the developing roller 33 (the outside diameter of the supply roller 32 is approximately 13 mm in the embodiment). The roller shaft 32*a* of the supply roller 32 is rotatably supported by both side walls 51 of the development casing 30, to which power is transmitted from the motor (not shown) during development.

When power is transmitted from the motor (not shown) to the supply roller 32, the supply roller 32 is rotated in the direction of the arrow (counterclockwise) so as to rotate in the direction opposite to the developing roller 33 at a nip portion where the supply roller 32 contacts the developing roller 33. The peripheral speed of the supply roller 32 is 0.5–2 times as fast as that of the developing roller 33 (0.73 times in the embodiment).

The developing roller 33 is disposed facing the supply roller 32 under the supply roller 32 at the front lower side in the developing chamber 47, in such a manner as to press against the supply roller 32. The developing roller 33 is disposed so as to face the developing roller front-side cover wall portion 41 at the front side, and the blade support wall 45 at the rear side. The developing roller 33 is arranged such that the lower side surface of the developing roller 33 is exposed from the development casing 30.

Figure 3:
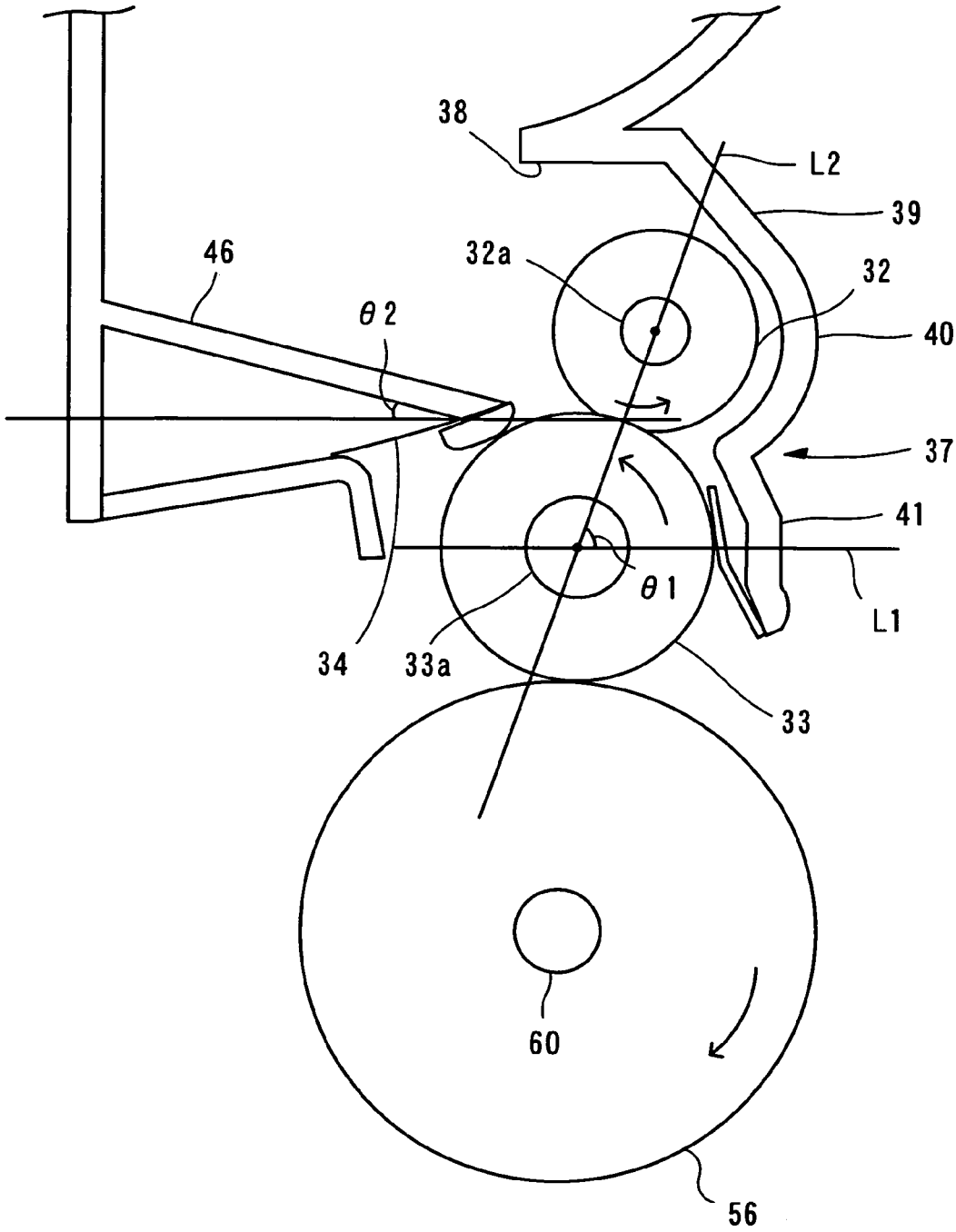
FIG. 3 is an enlarged side sectional view of essential parts shown in FIG. 2.

More specifically, as shown in FIG. 3, the developing roller 33 is arranged such that an angle θ1 formed by a first line L1 horizontally passing through a center of rotation of a roller shaft 33*a* of the developing roller 33 and a second line L2 connecting the center of rotation of the roller shaft 33*a* of the driving roller 33 and a center of rotation of the roller shaft 32*a* of the supply roller 32 is 45° or greater and up to 90° (70° in the embodiment).

As shown in FIG. 2, the developing roller 33 is made by covering the roller shaft 33*a* of metal with a roller portion made of elastic member, such as a conductive rubber material. More specifically, the roller portion of the developing roller 33 is provided by a two-tier structure of an elastic roller part and a coat layer that covers the surface of the roller part. The elastic roller part is made of conductive rubber, which includes carbon particles, such as urethane rubber, silicone rubber, and ethylene-propylene-diene-terpolymer (EPDM) rubber. The coat layer is made of urethane rubber, urethane resin, polyimide resin or other materials as a main intergradient. The outside diameter of the developing roller 33 is formed smaller than that of the photosensitive drum 56 (the outside diameter of the developing roller 33 is approximately 20 mm in the embodiment). The roller shaft 33*a* of the developing roller 33 is rotatably supported by both side walls 51 of the development casing 30, and during developing, power from the motor (not shown) is transmitted to the roller shaft 33*a*. When power is transmitted from the motor to the developing roller 33, the developing roller 33 is rotated in the direction of the arrow (counterclockwise), so as to rotate in the same direction as the photosensitive drum 56 at a nip portion where the developing roller 33 makes contact with the photosensitive drum 56. The peripheral velocity of the developing roller 33 is 0.5–2 times (1.6 times in the embodiment) that of the photosensitive drum 56. During developing, a developing bias is applied to the roller shaft 33*a* of the developing roller 33 from a power supply (not shown).

A film member 52 is provided at the developing roller front-side cover wall portion 41 and pressed against the front-side surface of the developing roller 33. The film member 52 prevents toner leakage from a gap between the front-side surface of the developing roller 33 and the developing roller front-side cover wall portion 41.

The layer thickness regulating blade 34 is provided across the entire width of the development casing 30, and disposed toward a downstream side in the rotation direction of the developing roller 33 from the position where the developing roller 33 and the supply roller 32 face each other. The layer thickness regulating blade 34 includes a blade body 53 made of a metal plate spring member and a pressing portion 54 having a generally semicircular shape in cross section, provided at a free end of the blade body 53, and made of insulative silicone rubber.

The blade body 53 is joined on the top surface of the blade support wall 45 at its proximal end, and disposed such that the free end of the blade body 53 extends frontward from the blade support wall 45 and faces the upper-side surface of the developing roller 33.

A sponge material (not shown) is provided on the top surface (toward the guide wall 46) at the free end of the blade body 53, and the free end of the guide wall 46 makes contact with the sponge material from above. This structure prevents toner, which is scraped by the developing roller 33, from entering between the guide wall 46 and the layer thickness regulating blade 34 and accumulating on the upper side of the layer thickness regulating blade 34.

This structure helps produce a flow of the developing agent along with the movement of the developing roller above the layer thickness regulating blade in addition to preventing the developing agent from accumulating above the layer thickness regulating blade. As a result, circulation of the developing agent can be secured and fogging can be prevented. Further, the flow of the developing agent, supported by the movement of the developing roller, above the layer thickness regulating blade can be guided toward the developing chamber by the guide wall.

The pressing portion 54 is provided on the bottom surface at the free end of the blade body 53, and is pressed against the upper-side surface of the developing roller 33 by elasticity of the blade body 53.

In the above-described arrangement, the upper-side surface of the developing roller 33 makes contact with the supply roller 32 at the front side and the pressing portion 54 of the layer thickness regulating blade 34 at the rear side at a distance from the nip portion formed with the supply roller 32. Thereby, the upper-side surface of the developing roller 33 makes contact with toner at a clearance between the nip portion with the supply roller 32 and the contact part with the pressing portion 54. The clearance is set to 2–10 mm (7 mm in the embodiment) as a length of the perimeter of the developing roller 33.

In the above-described arrangement, the guide wall 46 is joined to the top surface at the free end of the blade body 53 at its front end, and to the rear wall 43 at its rear end such that it inclines upwardly rearward (FIG. 3) with an angle θ2 greater than or equal to 0 degrees (20 degrees in the embodiment) relative to the horizontal, in a state that covers the blade body 53 and the blade support wall 45.

In the above-described arrangement, the supply roller upper wall portion 38, the supply roller 32, and the developing roller 33 are disposed overlapping each other in the vertical direction. More specifically, in the vertical direction, the supply roller 33 is entirely covered with the supply roller upper wall portion 38, while the developing roller 33 is disposed such that the rear-side surface of the developing roller 33 is exposed from the rear end of the supply roller upper wall portion 38.

With this structure, the developing agent circulated from the toner chamber under the first wall and an area in contact with the supply roller can be sufficiently secured, whereby supply of the developing agent circulating from the supply roller to the developing roller is stabile.

When toner stored in the toner chamber 31 flows from the rear end portion of the agitator facing wall 36 toward the developing chamber 47 by the agitation of the agitating member 50, the toner is supplied to the developing roller 33 through the rotation of the supply roller 32 while being positively charged between the supply roller 32 and the developing roller 33. At this time, as the supply roller 32 and the developing roller 33 rotate in opposite directions at the nip portion therebetween, the toner supplied from the supply roller 32 to the developing roller 33 is efficiently charged and excellent development is accomplished. Further, toner that was not transferred to the photosensitive drum 56 and has remained on the developing roller 33 can be excellently removed by the supply roller 32.

As a result, the developing agent scraped from the developing roller can flow along with a movement of the supply roller without interference, and fogging caused by a circulation failure of the scraped developing agent can be reduced, thereby obtaining excellent image formation.

When the toner supplied to the developing roller 33 and charged by friction goes in between the pressing portion 54 of the layer thickness regulating blade 34 and the developing roller 33 along with the rotation of the developing roller 33, it is uniformly regulated to a specified thickness and carried on the developing roller 33.

In the developing chamber 47, during developing, with the agitation of the agitating member 50, toner is made to flow from the toner chamber 31 via the rear end portion of the agitator facing wall 36 to the developing chamber 47, so that the first flow F1 is produced. With the rotation of the supply roller 32, toner is made to flow from the supply roller 32 toward the developing roller 33, so that a second flow F2 is produced. With this structure, circulation of the developing agent can be secured and fogging can be prevented.

Toner scraped off the upper-side surface of the developing roller 33 by the layer thickness regulating blade 34 is made to flow along the guide wall 46 through the rotation of the developing roller 33 to return to the toner chamber 31, so that a third flow F3 is produced.

In the toner chamber 31, toner that arrives by the third flow F3 is taken into the toner chamber 31 by the agitator 48 that rotates in the same direction as the third flow F3, agitated in the toner chamber 31, and then made to flow again from the rear end portion of the agitator facing wall 36 to the developing chamber 47 as the first flow F1. In this way, during developing, toner is favorably circulated in each developing unit 20.

Thus, with this structure, the developing agent circulated from the developing chamber under the first wall and an area in contact with the supply roller can be sufficiently secured, thereby supply of the toner circulating from the supply roller to the developing roller is stable.

Each developing unit 20 is disposed at substantially the same position in the vertical direction, that is, arranged so as to overlap, or be aligned with, each other in the horizontal direction (FIG. 1). More specifically, each developing unit 20 and each scanner unit 19 is arranged so as to overlap each other successively in the horizontal direction above the sheet supply tray 12 (FIG. 1).

Each photosensitive drum unit 21 is detachably attached to the main casing 2, and includes a photosensitive drum 56 and a scorotron charger 57 in a drum casing 55. The photosensitive drum 56 is disposed facing the developing roller 33.

The drum casing 55 is integrally formed with a drum storing part 58, and a backup plate portion 59. The drum storing part 58 is a substantially rectangular frame having an opening therethrough in a top to bottom direction, and the backup plate portion 59 extends upward from the drum storing part 58 and receives the cover wall 37 of the development casing 30.

The photosensitive drum 56 is constructed from a metal cylindrical tube made of aluminum, which is coated with a photosensitive layer of an organic photosensitive member having polycarbonate as the main ingredient. The outside diameter of the photosensitive drum 56 is formed larger than that of the developing roller 33 (the outside diameter of the photosensitive drum 56 is approximately 30 mm in the embodiment). The photosensitive drum 56 is rotatably supported by both side walls of the drum storing part 56 via a rotary shaft 60. During toner transfer, power is transmitted from a motor (not shown) to the rotary shaft 60. When power is transmitted from the motor, the photosensitive drum 56 is rotated in the direction of the arrow (clockwise) so as to rotate in the same direction as the conveyor belt 67 at a nip portion where the photosensitive drum 56 makes contact with the conveyor belt 67.

The scorotron charger 57 is fixed to the rear wall of the drum storing part 58 at a distance from the rear side of photosensitive drum 56. The scorotron charger 57 is of a positive charge type and generates a corona discharge from a charging wire, such as a tungsten wire. The scorotron charger 57 is disposed so as to positively and uniformly charge the surface of the photosensitive drum 56 through application of a voltage from a power supply (not shown).

When the photosensitive drum 56 is rotated, the surface of the photosensitive drum 56 is uniformly, positively charged by the scorotron charger 57. Then, with the rotation of the photosensitive drum 56, a laser beam from the scanner unit 19 is scanned at high speed on the surface of the photosensitive drum 56, thereby forming an electrostatic latent image thereon based on image data. When the photosensitive drum 56 then faces the developing roller 33, positively charged toner carried on the developing roller 33 is electrically moved to the electrostatic latent image formed on the surface of the photosensitive drum 56, where the potential has become low due to exposure to the laser beam. As a result, the latent image becomes visible and a reversal takes place. Thus, toner image of each color is formed on the photosensitive drum 56.

Each photosensitive drum unit 21 is disposed substantially at the same position in the vertical direction, that is, arranged such as to overlap, or be aligned with, each other in the horizontal direction (FIG. 1). Each photosensitive drum 56 is disposed so as to face its developing roller 33 in each developing unit 20 in the vertical direction.

Figure 4:
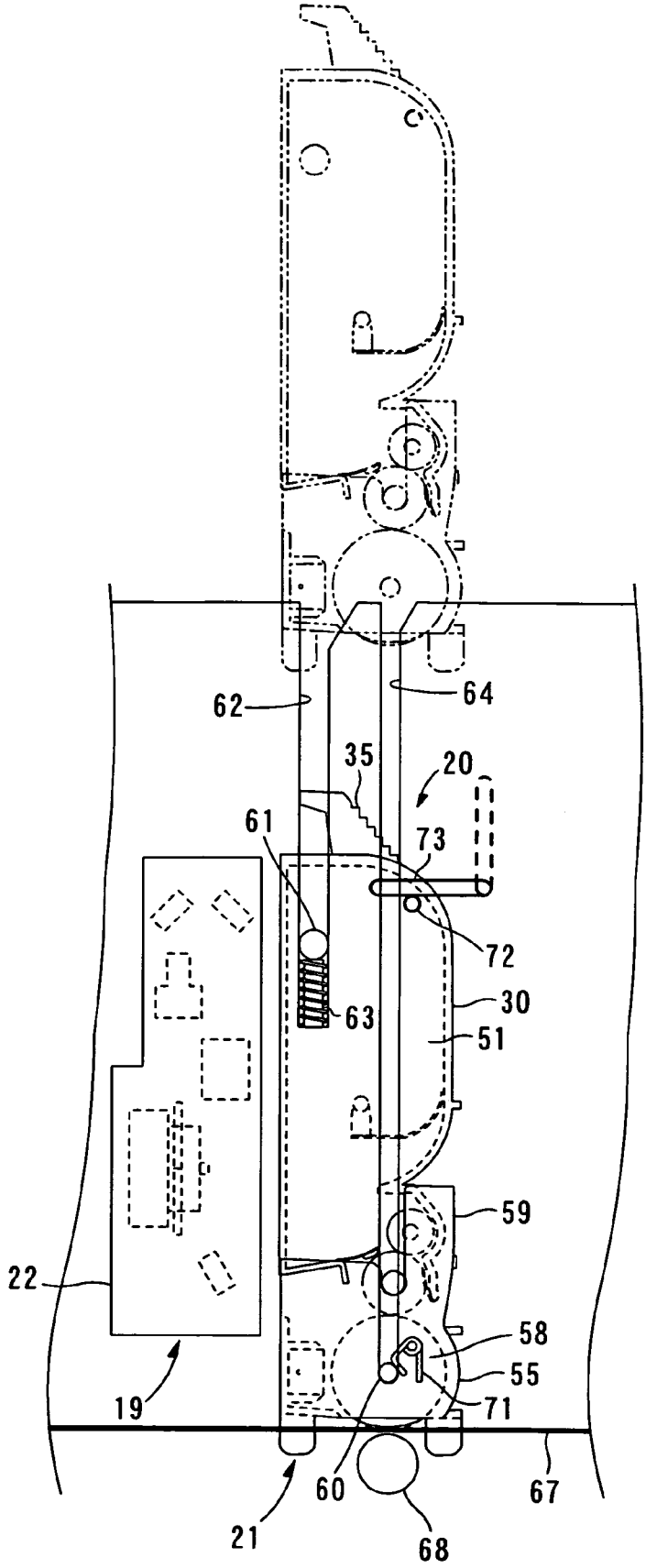
FIG. 4 is a side sectional view of essential parts showing that a photosensitive drum and a developing unit are attached to and detached from a main casing in the color laser printer shown in FIG. 1.

The developing unit 20 and the photosensitive drum unit 21 are detachably attached to the main casing 2 in the vertical direction, as shown in FIG. 4. A guide shaft 61 is attached to each side wall 51 of each development casing 30 at the upper rear side so as to protrude outward from the process unit 16 with respect to its width.

Developing unit guide grooves 62 are formed on the sidewalls on both sides of the main casing 2 so as to associate with a set position of each developing unit 20. The developing unit guide grooves 62 extend vertically with respect to the sidewalls of the main casing 2. The developing unit guide grooves 62 are formed so that their upper end is open upward from the upper end of the main casing 2 when the top cover 7 is open. Buffer springs 63 are provided at the lower end of each of the developing unit guide grooves 62 so as to elastically make contact with the guide shaft 61 when the developing unit 20 is set in position.

Photosensitive drum unit guide grooves 64 are formed on the sidewalls on both sides of the main casing 2 so as to associate with a set position of each photosensitive drum unit 21. The photosensitive drum unit guide grooves 64 extend vertically with respect to the sidewalls of the main casing 2 and in parallel with the developing unit guide grooves 62. The photosensitive drum unit guide grooves 64 are formed so that their upper end is open upward from the upper end of the main casing 2 when the top cover 7 is open. Torsion springs 71 are provided at the lower end of each of the photosensitive drum unit guide grooves 64 so as to press against the rotary shaft 60 of the photosensitive drum 56.

The developing unit 20 and the photosensitive drum unit 21 can be set in position, shown by a solid line, by engaging the rotary shaft 60 of the photosensitive drum 56 and the guide shaft 61 of the development casing 30 in the photosensitive drum guide grooves 64 and the developing unit guide grooves 62 respectively and moving them downward. The developing unit 20 and the photosensitive drum unit 21 are detachable from the set position as indicated by a phantom line.

When the developing unit 20 and the photosensitive drum unit 21 are set in position, the rotary shaft 50 of the photosensitive drum 56 is positioned by the pressure of the torsion springs 71.

A contact shaft 72 is attached to the sidewall 51 on each side of each development casing 30, at the upper front side, so as to protrude outward from the process unit 16 with respect to its width. When the development casing 30 is set in position, the contact shaft 72 is pressed downward by pressing levers 73 provided on the main casing 2, thereby positioning the developing roller 33 with respect to the photosensitive drum 56.

The pressing levers 73 are moved to a retracted position, shown by a broken line, and a pressing position, shown by a solid line, with the motor (not shown) driven. When the photosensitive drum 56 rotates, the pressing levers 73 are moved to the pressing position, and when the photosensitive drum 56 stops, the pressing levers 73 are moved to the retracted position. Thereby, the developing roller 33 can be positioned so as to reliably make contact with the photosensitive drum 56. The pressing levers 73 may be worked with, if not the motor, but using the open/close timing of the top cover 7.

In the color laser printer 1, the developing unit 20 is detachably attached to the photosensitive drum unit 21, the developing unit 20 and the photosensitive drum unit 21 can be detached together from the main casing 2, and the developing unit 20 can be detached from the photosensitive drum unit 21 while remaining attached to the main casing 2.

The transfer part 17 is disposed opposite each developing unit 20 via each photosensitive drum 56 in the main casing 2, as shown in FIG. 1. The transfer part 17 includes a drive roller 65, a driven roller 66, the conveyor belt 67, and transfer rollers 68. The transfer rollers 68 and the photosensitive drums 56 are arranged to face each other.

The drive roller 65 is disposed further forward than the photosensitive drum 56 in the yellow process unit 16Y. The driven roller 66 is disposed further rearward than the photosensitive drum 56 in the black process unit 16K.

The conveyor belt 67 is an endless belt and is formed of a conductive resin, such as polycarbonate and polyimide, in which conductive particles, for example, carbon particles, are dispersed. The conveyor belt 67 is stretched between the drive roller 65 and the driven roller 66. The conveyor belt 67 is disposed so as to make contact with the photosensitive drum 56 of each process unit 16 at its outer contact surface.

When the drive roller 65 is driven, the driven roller 66 is rotated, the conveyor belt 67 is moved around between the drive roller 65 and the driven roller 66 in the counterclockwise direction so as to rotate in the same direction as the photosensitive drum 56 of each process unit 16 at the contact surface.

The transfer rollers 68 are provided inside the conveyor belt 67 so as to face the respective photosensitive drums 56 of each process unit 16 via the conveyor belt 67. The transfer rollers 68 are made by covering metal roller shafts with roller portions formed of elastic member, such as conductive rubber material. The transfer rollers 68 are provided rotatable in the counterclockwise direction so as to rotate in the same direction as the conveyor belt 67 at the contact surface between the transfer rollers 68 and the conveyor belt 67. During image transfer, a transfer bias is applied to the transfer rollers 68.

The sheet 3, supplied from the sheet feeding unit 4, is conveyed by the conveying rollers 14, passing between the conveyor belt 67, which is moved by the drive roller 65 and the driven roller 66, and the photosensitive drum 56 of each process unit 16. While the sheet 3 passes where between, toner images of each color formed on the photosensitive drums 56 of each process unit 16 are sequentially transferred to the sheet 3, thereby a color image is formed on the sheet 3.

For example, when a yellow toner image formed on the photosensitive drum 56 of the yellow process unit 16Y is transferred to the sheet 3, a magenta toner image formed on the photosensitive drum 56 of the magenta process unit 16M is then transferred to the sheet 3 where the yellow toner image has been already transferred. In a similar manner, a cyan toner image formed by the cyan process unit 16C and a black toner image formed by the black process unit 16K are sequentially transferred and overlaid, and thus a color image is formed on the sheet 3.

As the color laser printer 1 is a tandem printer having the photosensitive drums 56 for each color, the toner images of each color can be formed at substantially the same speed as that for monochrome image formation, thereby obtaining rapid color image formation. Furthermore, as the first wall 36, 38, 39 and the guide wall 46 are provided for each color, circulation of the developing agent of each color can be secured and fogging of the color image can be prevented.

The fixing part 18 is provided further rearward than the process units 16 and the transfer part 17 and at a downstream side with respect to the sheet feed direction. The fixing part 18 includes a heat roller 70 and a pressure roller 69. The heat roller 70 is made of a metal tube on which a release layer is formed, and includes a halogen lamp along its axial direction. The surface of the heat roller 70 is heated to a fixing temperature by the halogen lamp. The pressure roller 69 is provided so as to press against the heat roller 70. The color image transferred on the sheet 3 is fixed by heat while passing between the heat roller 70 and the pressure roller 69 at the fixing part 18.

The sheet ejection part 6 includes the sheet discharge slot 9, the sheet discharge tray 10, and the ejection rollers 11. The sheet 3, where the image is fixed by heat, is ejected by the ejection rollers 11 from the sheet discharge slot 9 outside the main casing 2, and stacked on the sheet discharge tray 10.

In each developing unit 20 of the color laser printer 1, the supply roller upper wall portion 38 is provided at the front wall 44 of the development casing 30, and the supply roller upper wall portion 38 covers the upper portion of the supply roller 32 and divides it from the toner chamber 31. Thus, the weight of the toner stored in the toner chamber 31 is received by the supply roller upper wall portion 38, thereby preventing the weight of the toner from directly acting on the supply roller 32.

Thus, toner existing between the supply roller upper wall portion 38 and the upper portion of the supply roller 32 flows along with the rotation of the supply roller 32, thereby producing the second flow F2 of toner that flows from the supply roller 32 toward the developing roller 33. This prevents the flow of toner produced by the rotation of the supply roller 32 from being inhibited. The toner scraped from the developing roller 33 by the supply roller 32 flows following the second flow F2, merges with the toner of the third flow F3, moves into the toner chamber 31, is mixed with other toner, and recirculated.

Especially, the supply roller upper wall portion 38 is integrally formed with the supply roller inclined wall portion 39 to encompass the entire roller portion of the supply roller 32 within a plane of projection in a vertical direction near the supply roller 32. Thus, the weight of the toner stored in the toner container 31 can be more reliably prevented from directly acting on the supply roller 32.

In addition, in each developing unit 20, the guide wall 46 is provided near the opposite position between the layer thickness regulating blade 34 and the developing roller 33. Toner scraped from the developing roller 33 by the layer thickness regulating blade 34 flows along the guide wall 46, thereby producing the third flow F3 of toner to return to the toner chamber 31. Thus, the toner scraped from the developing roller 33 by the layer thickness regulating blade 34 can be prevented from building up on the blade support wall 45, circulation of the toner can be secured, and image fogging can be prevented.

In other words, if it were not for the guide wall 46, the toner scraped from the developing roller 33 by the layer thickness regulating blade 34 would partly return to the toner chamber 31 but would partly flow over the upper portion of the layer thickness regulating blade 34 and the blade support wall 45, so that the toner would accumulate on the blade support wall 45 without circulation.

However, the guide wall 46 is provided, as described above, so as to cover the blade support wall 45 and the layer thickness regulating blade 34 from above and inclined with the front end being lowered, which is near the developing roller 33, and the rear end being raised, which is far from the developing roller 33, with respect to the horizontal line. Thus, the toner scraped from the developing roller 33 by the layer thickness regulating blade 34 flows along with the rotation of the developing roller 33 without accumulating on the blade support wall 45, is guided by the guide wall 46 to the toner chamber 31, and, thus, produces the third flow F3 of toner to return the toner to the toner chamber 31. As a result, accumulation of toner on the blade support wall 45 can be prevented, circulation of the toner can be secured, and fogging can be prevented.

As shown in FIG. 3, in each developing unit 20, the developing roller 33 is disposed such that angle θ1 is greater than or equal to 45°, which is formed by a first line L1 horizontally passing through the center of the rotation of the developing roller 33 and a second line L2 connecting the center of rotation of the developing roller 33 and the center of rotation of the supply roller 32. Thus, as shown in FIG. 2, an area of the supply roller 32 at the rear side surface that makes contact with the toner flowing from the toner chamber 31 with the first flow F1 can be secured adequately. As a result, as toner is circulated from the supply roller 32 to the developing roller 33, it can be supplied with stability. Thus, stable circulation of toner can be secured and fogging can be prevented.

In each developing unit 20, the rotation direction of the agitator 48, which is provided in the toner chamber 31, is the same direction as the flow of toner produced near the developing roller 33 by the rotation of the developing roller 33, that is, the third flow F3 of toner returning to the toner chamber 31. Thus, the toner flowing as the third flow F3 can be merged with the flow of toner agitated by the agitator 48 rotated in the same direction. The toner flowing as the third flow F3 is taken in the toner chamber 31, agitated therein, and then flows from the rear end portion of the agitator facing wall 36 toward the developing chamber 47 as the first flow F1. In this way, a more stable flow of toner can be established, and toner can be circulated more stably.

In the laser printer 1, as polymerized toner having substantially spherical particles is used, the flowability of the toner can be improved. Thus, toner can be more stably circulated.

Especially in the laser printer l, as toner whose packed bulk density in an early use (including unused state) is greater than or equal to 0.646 g/ml is used, it can be sufficiently supplied from the toner chamber 31 to the supply roller 32. Thus, a reduction in image formation density at the early use is prevented, so that preferable image formation is obtained.

The above description is made based on the tandem laser printer 1 of direct transfer type where transfer is performed on the sheet 3 directly from each photosensitive drum 56. However, the invention is not limited to this kind of printer. The invention may be applied to a tandem color laser printer of intermediate transfer type where a toner image of each color is once transferred from each photosensitive member to an intermediate transfer member as a transfer member, and then transferred to a sheet by one operation.

In the above description, the first wall of the invention is formed by the agitator facing wall 36, the supply roller upper side wall portion 38, and the supply roller inclined wall portion 39. However, the first wall may be constructed only from the agitator facing wall 36 of the front wall 44 by extending the supply roller front-side cover wall portion 40 upward to connect with an upper portion of the agitator facing wall 36, without the supply roller upper side wall portion 38 and the supply roller inclined wall portion 39. However, to produce the second flow F2 of toner in the developing chamber 47 along with the rotation of the supply roller 32, it is preferable that the supply roller upper side wall portion 38 and the supply roller inclined wall portion 39 be formed.

EXAMPLE

Toners, each in which two different additives of varying particle sizes were mixed into toner base particles in the proportion indicated in Table 1, were prepared.

The packed bulk density of each toner before use (equivalent to the packed bulk density in an early use) was determined by the following method. Using the color laser printer of the above-described embodiment, each toner was evaluated based on comparisons between prints with a new developing unit 20 just after printing was started for the first time) and prints made a given time interval after starting printing. Table 1 shows the evaluation results.

Measuring method of the packed bulk density: using Powder Tester PT-R manufactured by Hosokawa Micron, the packed bulk density of each toner was found by filling more than 100 ml of toner into a cylindrical tube, tapping the cylindrical tube 180 times, separating the upper part of the cylindrical tube to scrape 100 ml of toner, and measuring its weight.

In Table 1, O indicates that stable image density was achieved on 15th sheet or later; Δ indicates that stable image density was achieved on 30th sheet or fewer; and x indicates that stable image density was achieved from 31st sheet to 60th sheet.

TABLE 1

| | Toner number | | | | | | |
|---|---|---|---|---|---|---|---|
| | 1 | 2 | 3 | 4 | 5 | 6 | 7 |
| Small particle size additive (wt %) *1 | 0.5 | 1 | 0 | 0 | 0.5 | 1 | 1 |
| Large particle size additive (wt %) *2 | 0 | 0 | 0.5 | 1 | 1 | 0.5 | 1 |
| Packed bulk density (g/ml) | 0.646 | 0.658 | 0.635 | 0.639 | 0.652 | 0.656 | 0.649 |
| Prints with new developing unit | ○ | ○ | X | X | ○ | ○ | ○ |
| Prints left a given time interval after printing | ○ | Δ | ○ | ○ | ○ | ○ | ○ |

*1: The mean particle diameter of the small particle size additive is about 20 mm.
*2: The mean particle diameter of the large particle size additive is about 40 mm.

It is apparent from Table 1 that toner whose packed bulk density is greater than or equal to 0.646 g/ml is appropriate for prevention of image degradation in initial printing. It is also apparent from Table 1 that toner whose packed bulk density is smaller than 0.656 g/ml is appropriate for prevention of image degradation in printing after a specified interval.

What is claimed is:

1. A developing device, comprising:

a toner chamber that contains a developing agent;

a developing agent carrier that carries the developing agent;

a supply device that is disposed facing the developing agent carrier and in contact with the developing agent carrier and supplies the developing agent stored in the toner chamber to the developing agent carrier, the developing agent carrier and the supply device disposed below the toner chamber when the developing device is mounted in an image forming apparatus;

a first wall that covers the entire supply device and prevents a weight of the developing agent contained in the toner chamber from directly acting in a vertical direction on an entirety of the supply device;

a layer thickness regulating member that regulates a thickness of the developing agent carried on the developing agent carrier at a downstream side from a facing position of the developing agent carrier and the supply device with respect to a movement direction of the developing agent carrier; and a second wall having a first end disposed near a facing position of the developing agent and the layer thickness regulating member over the layer thickness regulating member when the developing device is mounted in the image forming apparatus, the second wall having a second end opposite of the first end, the second wall being inclined with the first end lower than the second end, wherein the second wall is structured to guide the developing agent scraped from the developing agent carrier by the layer thickness regulating member to flow toward the toner chamber.

2. The developing device according to claim 1, wherein the second wall is structured to prevent the developing agent from accumulating above the layer thickness regulating member when the developing device is mounted in the image forming apparatus.

3. An image forming apparatus, comprising:

a main frame; and a developing unit that is attachable to and detachable from the main frame, the developing unit comprising:

a toner chamber that contains a developing agent;

a developing agent carrier that carries the developing agent;

a supply device that is disposed facing the developing agent carrier and in contact with the developing agent carrier and supplies the developing agent stored in the toner chamber to the developing agent carrier, the developing agent carrier and the supply device disposed below the toner chamber when the developing unit is mounted in the main frame of the image forming apparatus;

a first wall disposed between the toner chamber and the supply device and extends to completely cover the entirety of the supply device when the developing unit is mounted in the main frame of the image forming apparatus;

a layer thickness regulating member that regulates a thickness of the developing agent carried on the developing agent carrier at a downstream side from a facing position of the developing agent carrier and the supply device with respect to a movement direction of the developing agent carrier; and a second wall having a first end disposed near a facing position of the developing agent and the layer thickness regulating member over the layer thickness regulating member when the developing unit is mounted in the main frame of the image forming apparatus, the second wall having a second end opposite of the first end, the second wall being inclined with the first end lower than the second end, wherein the second wall is structured to guide the developing agent scraped from the developing agent carrier by the layer thickness regulating member to flow toward the toner chamber.

4. The image forming apparatus according to claim 3, comprising a plurality of toner chambers, developing agent carriers, supply devices, and first walls in the same number as a plurality of colors for the developing agent.

5. The image forming apparatus according to claim 4, comprising a plurality of second walls in the same number as a plurality of colors for the developing agent.

6. A developing unit for use with an electrorephotographic print device, the developing unit comprising:

a casing having a front wall, a rear wall, a top wall, and a pair of side walls, the casing divided into a toner chamber and a developing chamber;

a first wall extending from the front wall into the casing to create the toner chamber and the developing chamber;

an agitator mounted in the toner chamber;

a supply roller mounted in the developing chamber adjacent to the first wall and the front wall;

a developing roller mounted in the developing chamber to contact the supply roller on a side away from the first wall;

a regulating blade extending from the rear wall and in contact with the developing roller; and a second wall extending from the rear wall with a free end contacting the regulating blade at a side opposite where the regulating blade contacts the developing roller, the second wall having a second end opposite of the first end and joined to the rear wall, wherein where a second end is joined to the rear wall is closer to the toner chamber than where the free end of the second wall contacts the regulating blade, wherein the second wall is structured to guide the toner scraped from the developing roller by the regulating blade to flow toward the toner chamber.

7. The developing unit according to claim 6, wherein the first wall and the front wall form a recessed portion in which the supply roller is completely contained.

8. The developing unit according to claim 7, wherein a plane passing through the axis of the supply roller and the axis of the developing roller forms an acute angle with a vertical plane passing through the axis of the developing roller when the developing unit is mounted in the print device.

9. A developing device, comprising:

a toner chamber that contains a developing agent;

a developing agent carrier that carries the developing agent;

a supply device that is disposed facing the developing agent carrier and supplies the developing agent stored in the toner chamber to the developing agent carrier, the developing agent carrier and the supply device disposed below the toner chamber when the developing device is mounted in an image forming apparatus;

a first wall that is disposed between the toner chamber and the supply device and covers the entirety of the supply device when the developing device is mounted in the image forming apparatus, the first wall is integrally formed as one piece with a casing of the developing device, wherein a space is provided between a free end of the first wall and the supply device, wherein a distance between the supply device and the first wall is smaller than the size of the supply device;

a layer thickness regulating member that regulates a thickness of the developing agent carried on the developing agent carrier at a downstream side from a facing position of the developing agent carrier and the supply device with respect to a movement direction of the developing agent carrier; and a second wall having a first end disposed near a facing position of the developing agent and the layer thickness regulating member over the layer thickness regulating member when the developing device is mounted in the image forming apparatus, the second wall having a second end opposite of the first end, the second wall being inclined with the first end lower than the second end, wherein the second wall is structured to guide the developing agent scraped from the developing agent carrier by the layer thickness regulating member to flow toward the toner chamber.

10. The developing device according to claim 9, wherein the supply device is a supply roller, and the distance between an outer surface of the supply roller and the first wall is smaller than a diameter of the supply roller.

11. The developing device according to claim 9, wherein the distance between the supply device and the first wall is smaller than 10 mm or equal to 10 mm.

12. The developing device according to claim 9, wherein the supply device is a supply roller, and the first wall extends along an outer surface of the supply roller.

13. The developing device according to claim 9, wherein the developing agent carrier and the supply device are urged into contact with each other at a facing position, and move in opposite directions at the contact position.

14. A developing device, comprising:

a toner chamber that contains a developing agent;

a developing agent carrier that carries the developing agent;

a supply device that is disposed facing the developing agent carrier and in contact with the developing agent carrier and supplies the developing agent stored in the toner chamber to the developing agent carrier, the developing agent carrier and the supply device disposed below the toner chamber when the developing device is mounted in an image forming apparatus;

a first wall that is disposed between the toner chamber and the supply device and covers an upper portion of the supply device when the developing device is mounted in the image forming apparatus, wherein the first wall is disposed so as to store the entirety of the supply device within a plane of projection in a vertical direction from a free end of the first wall when the developing device is mounted in the main casing of the image forming apparatus;

a layer thickness regulating member that regulates a thickness of the developing agent carried on the developing agent carrier at a downstream side from a facing position of the developing agent carrier and the supply device with respect to a movement direction of the developing agent carrier; and a second wall having a first end disposed near a facing position of the developing agent and the layer thickness regulating member over the layer thickness regulating member when the developing device is mounted in the image forming apparatus, the second wall having a second end opposite of the first end, the second wall being inclined with the first end lower than the second end, wherein the second wall is structured to guide the developing agent scraped from the developing agent carrier by the layer thickness regulating member to flow toward the toner chamber.

15. The developing device according to claim 9, wherein the first wall is disposed so as to store the supply device within a plane of projection in a vertical direction of the first wall when the developing device is mounted in the image forming apparatus.

16. The developing device according to claim 9, wherein the first wall is disposed so as to produce a flow of the developing agent by moving the developing agent between the first wall and the supply device along with a movement of the supply device, when the developing device is mounted in the image forming apparatus.

17. The developing device according to claim 9, wherein the first wall is disposed near the supply device.

18. The developing device according to claim 9, wherein the first end of the second wall inclines downward and a second end of the second wall inclines upward.

19. The developing device according to claim 9, wherein the developing agent carrier is a developing roller, the supply device is a supply roller, and the developing roller and the supply roller are disposed such that an angle formed by a first line horizontally passing through a center of rotation of the developing roller and a second line connecting the center of rotation of the developing roller and a center of rotation of the supply roller is greater than or equal to 45 degrees, when the developing device is mounted in the image forming apparatus.

20. The developing device according to claim 9, wherein the developing agent is a toner having substantially spherical particles.

21. The developing device according to claim 9, wherein the developing agent has a packed bulk density greater than or equal to 0.646 g/ml at an initial use.

22. The developing device according to claim 9, further comprising an agitating member that is provided in the toner chamber and agitates the developing agent, wherein the agitating member moves, at the closest position to the developing agent carrier, in the same direction as a flow of the developing agent produced near the developing agent carrier by the movement of the developing agent carrier.

23. A developing device, comprising:

a toner chamber that contains a developing agent;

a developing roller that carries the developing agent; and a supply roller that is disposed facing the developing roller and in contact with the developing roller to form a nip therewith, and supplies the developing agent stored in the toner chamber to the developing roller, the developing roller and the supply roller disposed below the toner chamber when the developing device is mounted in the image forming apparatus, wherein the supply roller is disposed above the developing roller when the developing device is mounted in the image forming apparatus, and wherein the developing roller and the supply roller are disposed such that an angle formed by a first line horizontally passing through a center of rotation of the developing roller and a second line connecting the center of rotation of the developing roller and a center of rotation of the supply roller is greater than or equal to 45 degrees, when the developing device is mounted in the image forming apparatus;

a first wall that is disposed between the toner chamber and the supply roller and covers an entirety of the supply roller when the developing device is mounted in the image forming apparatus;

a layer thickness regulating member that regulates a thickness of the developing agent carried on the developing roller at a downstream side from a facing position of the developing roller and the supply roller with respect to a rotatinal direction of the developing roller; and a second wall having a first end disposed near a facing position of the developing roller and the layer thickness regulating member over the layer thickness regulating member when the developing device is mounted in the image forming apparatus, the second wall having a second end opposite of the first end, the second wall being inclined with the first end lower than the second end, wherein the second wall is structured to guide the developing agent scraped from the developing roller by the layer thickness regulating member to flow toward the toner chamber.

24. The developing device according to claim 23, wherein the first wall extends along an outer surface of the supply roller.

25. The developing device according to claim 1, wherein the developing device is attachable to and detachable from a main casing of the image forming apparatus.

26. The developing device according to claim 9, wherein the developing device is attachable to and detachable from a main casing of the image forming apparatus.

27. The developing device according to claim 14, wherein the developing device is attachable to and detachable from a main casing of the image forming apparatus.

28. The developing device according to claim 23, wherein the developing device is attachable to and detachable from a main casing of the image forming apparatus.

29. The developing device according to claim 20, wherein the toner is a single-component toner.

* * * * *